US010285249B2

(12) United States Patent
Mason et al.

(10) Patent No.: US 10,285,249 B2
(45) Date of Patent: May 7, 2019

(54) LIGHTING SYSTEM CONTROLLER

(71) Applicant: SIGNIFY HOLDING B.V., Eindhoven (NL)

(72) Inventors: Jonathan David Mason, Waalre (NL); Dzmitry Viktorovich Aliakseyeu, Eindhoven (NL); Sanae Chraibi, Eindhoven (NL); Remco Magielse, Tilburg (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/550,426

(22) PCT Filed: Jan. 19, 2016

(86) PCT No.: PCT/EP2016/050998
§ 371 (c)(1),
(2) Date: Aug. 11, 2017

(87) PCT Pub. No.: WO2016/128183
PCT Pub. Date: Aug. 18, 2016

(65) Prior Publication Data

US 2018/0242432 A1 Aug. 23, 2018

(30) Foreign Application Priority Data

Feb. 11, 2015 (EP) ..... 15154688

(51) Int. Cl.
*H05B 37/02* (2006.01)

(52) U.S. Cl.
CPC ..... *H05B 37/0272* (2013.01)

(58) Field of Classification Search
CPC ..... H05B 37/0272
USPC ..... 315/297
See application file for complete search history.

(56) References Cited

U.S. PATENT DOCUMENTS

| | | | | |
|---|---|---|---|---|
| 6,153,858 | A | 11/2000 | Barnes et al. | |
| 2008/0141478 | A1 | 6/2008 | Gatzemeyer et al. | |
| 2010/0141153 | A1* | 6/2010 | Recker | H05B 33/0803 315/149 |
| 2012/0215328 | A1 | 8/2012 | Schmelzer | |
| 2013/0063042 | A1* | 3/2013 | Bora | H05B 33/0863 315/292 |
| 2013/0221852 | A1* | 8/2013 | Bowers | H05B 33/0863 315/131 |
| 2014/0023363 | A1 | 1/2014 | Apte et al. | |
| 2014/0265920 | A1* | 9/2014 | Pederson | H05B 33/0842 315/294 |

(Continued)

FOREIGN PATENT DOCUMENTS

WO 2014097022 A1 6/2014

*Primary Examiner* — Don P Le
(74) *Attorney, Agent, or Firm* — Meenakshy Chakravorty

(57) ABSTRACT

A lighting system controller (11) configured to control at least one controllable luminaire (43), the lighting system controller comprising: a task definer (101) configured to define at least one task to be performed; a status determiner (103) configured to determine a status of the at least one task based on sensor data received from at least one device (21) physically separated from the lighting system controller (11); and a control signal controller (107) configured to output at least one lighting system signal to the at least one controllable luminaire (43) based on the status determiner (103).

11 Claims, 7 Drawing Sheets

(56) References Cited

U.S. PATENT DOCUMENTS

| | | | | |
|---|---|---|---|---|
| 2014/0354161 | A1* | 12/2014 | Aggarwal | H05B 37/0245 315/153 |
| 2014/0358285 | A1 | 12/2014 | Aggarwal et al. | |
| 2015/0033138 | A1 | 1/2015 | Manchanda | |
| 2015/0040005 | A1 | 2/2015 | Faaborg et al. | |
| 2015/0264781 | A1* | 9/2015 | Juslen | H05B 37/0218 315/153 |
| 2015/0350031 | A1* | 12/2015 | Burks | H04L 41/22 715/736 |
| 2016/0165679 | A1* | 6/2016 | Laherty | H05B 33/086 315/294 |
| 2016/0174347 | A1* | 6/2016 | Parello | H05B 37/0272 315/294 |
| 2017/0238401 | A1* | 8/2017 | Sadwick | A61N 5/01 315/294 |

* cited by examiner

LIGHTING SYSTEM CONTROLLER

CROSS-REFERENCE TO PRIOR APPLICATIONS

This application is the U.S. National Phase application under 35 U.S.C. § 371 of International Application No. PCT/EP2016/050998, filed on Jan. 19, 2016, which claims the benefit of European Patent Application No. 15154688.4, filed on Feb. 11, 2015. These applications are hereby incorporated by reference herein.

TECHNICAL FIELD

The present disclosure relates to a lighting system controller and method for controlling a luminaire within a lighting system based on a user's performance of a task. Particularly, the present disclosure relates to a lighting system controller for and method for controlling a luminaire within a lighting system based on monitoring tasks performed by users of the lighting system.

BACKGROUND

Modern luminaires incorporate not only the components necessary to drive the luminous element (e.g. a LED string), but are also capable of integrating significant additional functionality, e.g. including network connectivity.

Furthermore modern luminaires can be controlled using networked lighting system controllers to produce various lighting effects. Typically a lighting system controller can receive a lighting input such as from a physical switch or a software defined switch such as implemented as a user interface element in a lighting application. The lighting system controller can then generate suitable control signals based on the lighting input. These control signals then being transmitted over the network to a lighting system luminaire.

Lights implemented as indicator or panel lights have been used previously to indicate a condition of a device, and whether a device is being used correctly.

For example US patent application publication number US 2008/0141478 describes a toothbrush with LED lights arranged in a lighted segment configuration which can be sequentially illuminated to indicate a recommended brushing sequence. This sequence can be represented by a sequence of brushing rules and tasks/routines.

The modern world is governed by rules and tasks such as these. These rules and tasks can be as simple as the rules for brushing teeth. Other tasks or rules require professional tuition and many hours of practice and repetition to learn. However by learning such tasks they assist users in collating pieces of information and reduce the user's cognitive load. For example for a user in an unfamiliar vehicle the tasks or rules associated with driving the vehicle may distract the driver from fully paying attention to the environment in which the vehicle is being driven. Thus the tasks may include starting a vehicle (does the vehicle require the gearbox to be placed in neutral or the clutch engaged before starting the engine), selecting or changing gear (does the clutch need to be engaged before selecting a 'new' gear, does the gearbox require double declutching), and moving off (does the vehicle require the handbrake to be released before fully engaging the drive/disengaging the clutch, does the vehicle have an electronic or automatic handbrake). Once these and other tasks are learned they enable the user to perform complex tasks (such as driving a vehicle) without significant mental stress.

Furthermore some routines may comprise sets or lists of tasks which need to be performed with little margin for error. Often such routines require checklists or database systems to log the state of tasks so that users can keep track of their progress. An example of such routines can be the operation of machinery in safety critical environments such as control rooms.

The frequency of the performance of tasks or routines may furthermore vary. Those tasks being performed very frequently may be learnt quickly because of their very frequent use. However those tasks which are required and performed less frequently are thus more often forgotten or missed.

Learning or remembering these tasks or routines can sometimes be assisted by generating and following a list or checklist.

Often these are in the form of paper-based lists or checklists of the tasks or routines. These paper-based lists however can be lost, hidden, damaged or may not be updated when the task or routine is changed. Digital versions of lists or checklists, which can be stored on smart devices such as a tablet computers, while capable of having audio or visual feedback can be similarly lost or misplaced within the bags or pockets. Furthermore some users may resent the need to carry about a 'further electronic device' comprising the digital version of the list or believe the digital version to be too complicated or inconvenient to use and thus is effectively useless.

SUMMARY

The following provides a technique for providing a controllable lighting system suitable for assisting a user to perform and/or remember tasks by providing suitable light-based feedback via a controllable luminaire. It is based on the principle of using a lighting system controller within a controllable lighting system to help define a routine, sequence or list of tasks with respect to a network of sensor generated signals received at the lighting controller. For example the lighting system controller can be configured to activate or release control signals for a certain light scene only once a certain sequence of tasks have been observed.

Depending on the application the light scene may be generated when the tasks are completed in a particular sequence or order or the light scene may be generated when the tasks are completed in any order.

According to one aspect disclosed herein, there is provided a lighting system controller configured to control at least one controllable luminaire, the lighting system controller comprising: a task definer configured to define at least one task to be performed; a status determiner configured to determine a status of the at least one task based on sensor data received from at least one device physically separated from the lighting system controller; and a control signal controller configured to output at least one lighting system signal to the at least one controllable luminaire based on the status determiner.

The lighting system controller further comprises a control signal generator configured to generate the at least one lighting system signal based on (or: according to) a received lighting system signal input, and wherein the control signal controller may be configured to output the at least one lighting system signal to the at least one controllable luminaire based on (or: under the condition of) the status determiner indicating that the at least one task has been completed.

The task definer may be further configured to define a task order for the at least one task to be performed, and the control signal controller is configured to output the at least one lighting system signal to the at least one controllable luminaire based on (or: under the condition of) the status determiner indicating that the at least one task has been performed in the defined order.

The lighting system controller may further comprise a wireless receiver configured to receive the sensor data from the at least one device physically separated from the lighting system controller.

The lighting system controller may further comprise a wireless transmitter configured to transmit the at least one lighting system signal to the at least one controllable luminaire.

The task definer may be configured to receive the at least one task to be performed from a physically separate device.

The lighting system controller may further comprise a task recorder configured to: analyses the sensor data received from the at least one device physically separated from the lighting system controller to determine a pattern of sensor data associated with at least one task; and determine a definition for the at least one task comprising the determined pattern of sensor data associated with the at least one task.

The lighting system controller may further comprise a task analyzer configured to analyses status output data from the task status determiner and determine a performance analysis of the at least one task.

A lighting system may comprise: the lighting system controller as described herein; the at least one controllable luminaire in communication with the lighting system controller; and at least one device in communication with the lighting system controller, the at least one device comprising at least one sensor for generating the sensor data.

According to a second aspect there is provided a computer program product comprising code embodied on one or more computer-readable storage media and/or being downloadable therefrom, and being configured so as when run on a lighting system controller to perform operations of: define at least one task to be performed; determine a status of the at least one task based on sensor data received from at least one device physically separated from the lighting system controller; receive a lighting system signal input; generate at least one lighting system signal based on (or: according to) the received lighting system signal input, and control, based on (or: under the condition of) the determined status indicating that the at least one task has been completed, the output of the at least one lighting system signal associated with the at least one task to the at least one controllable luminaire.

According to a third aspect there is provided a method of controlling a controllable luminaire comprising: defining at least one task to be performed; determining a status of the at least one task based on sensor data received from at least one device physically separated from the lighting system controller; receiving a lighting system signal input; generating at least one lighting system signal based on (or: according to) the received lighting system signal input, and controlling, based on (or: under the condition of) the determined status indicating that the at least one task has been completed, the output of the at least one lighting system signal associated with the at least one task to the at least one controllable luminaire.

The method may further comprise: receiving a lighting system signal input; generating the at least one lighting system signal based on the lighting system signal input; and wherein controlling the output the at least one lighting system signal to the at least one controllable luminaire may comprise controlling the output of the at least one lighting system signal to the at least one controllable luminaire based on the status indicating that the at least one task has been completed.

Defining the at least one task to be performed may comprise defining an order for the at least one task to be performed, and controlling the output of the at least one lighting system signal to the at least one controllable luminaire may comprise controlling the output of the at least one lighting system signal based on the status indicating that the at least one task has been performed in the defined order.

The method may further comprise receiving the sensor data from the at least one device physically separated from the lighting system controller.

The method may further comprise transmitting the at least one lighting effect control signal to the at least one controllable luminaire.

BRIEF DESCRIPTION OF THE DRAWINGS

To assist understanding of the present disclosure and to show how embodiments may be put into effect, reference will be made by way of example to the accompanying drawings in which.

DETAILED DESCRIPTION OF EMBODIMENTS

This invention uses the lighting to help a user perform or remember a routine, sequence, or list of tasks. This can be implemented so that once a certain sequence of events has occurred only then the defined or certain light scene (that is not available otherwise) is activated.

Figure 1:
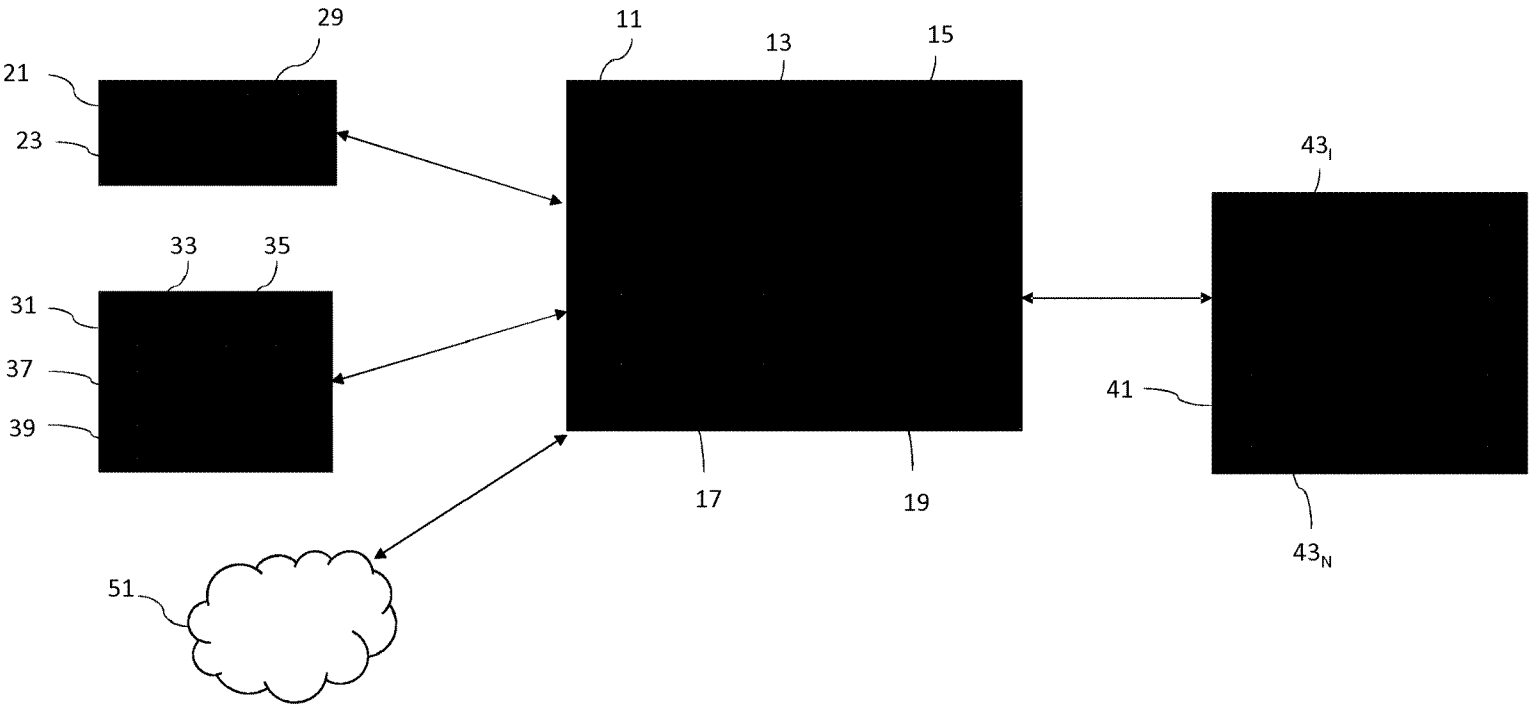
FIG. 1 is a schematic illustration of an environment including a lighting system suitable for implementing some embodiments.

With respect to FIG. 1 an example lighting system controller 11 suitable for monitoring tasks and controlling a lighting system based on the monitoring of the tasks is shown. The lighting system controller 11 is shown comprising a processor or CPU 13, a memory 15, a user interface 17 and a transceiver 19. The lighting system controller 11 is shown as being wirelessly coupled to the lighting system 41 and furthermore wirelessly coupled to at least one task monitoring sensor 21, at least one monitoring system, and at least one network 41.

The processor 13 can in some embodiments be configured to execute various program codes. The implemented program codes in some embodiments comprise task monitoring, and lighting system control code as described herein. The implemented program codes can in some embodiments be stored for example in the memory 15 for retrieval by the processor 13 whenever needed. The memory 15 could further provide a section for storing data, for example sensor or lighting system control signal data in accordance with the application as described herein.

The task defining, task monitoring, and lighting system controlling code in embodiments can be implemented at least partially in hardware and/or firmware.

The user interface (UI) 15 enables a user to input commands to the lighting system controller 11, for example via a keypad, and/or to obtain information from the lighting system controller 11, for example via a display. In some embodiments a touch screen may provide both input and output functions for the user interface.

The lighting system controller 11 in some embodiments comprises a transceiver (TX/RX) 19 suitable for enabling communication with other apparatus, for example via a wireless communication network. The transceiver 19 can communicate with other apparatus by any suitable known communications protocol, for example in some embodiments the transceiver 19 or transceiver means can use a suitable universal mobile telecommunications system (UMTS) protocol, a wireless local area network (WLAN) protocol such as for example IEEE 802.X, a suitable short-range radio frequency communication protocol such as Bluetooth, ZigBee or infrared data communication pathway (IRDA).

It is to be understood again that the structure of the lighting system controller 11 could be supplemented and varied in many ways.

The lighting system 41 can be any suitable controllable lighting system. In the example shown in FIG. 1 the lighting system 41 comprises a number of controllable luminaires $\mathbf{43}_1$ and $\mathbf{43}_n$. The luminaires may be implemented using any suitable controllable light generating technology. In some embodiments each of the luminaires may for example comprise a controller configured to receive a control signal from the lighting system controller 11 and implement the control signal to produce a desired lighting effect or scene. In some embodiments each luminaire 43 can be individually addressed and controlled. Furthermore in some embodiments each luminaire comprises different and individually controllable color light sources and therefore controllable to produce a desired color lighting effect or scene.

The lighting system controller 11 is shown in FIG. 1 as being wirelessly coupled to a sensor 21. It is understood that the lighting system controller 11 may in some embodiments be coupled to more than one sensor 21 or device operating as a sensor. The sensor 21 may in some embodiments be physically separate or separable from the lighting system controller 11. The sensor 21 or device in some embodiments comprises at least one sensor entity or array of sensors 23. Furthermore the sensor 21 or device may comprise a transceiver 29 (or transmitter where only one way communication is required) configured to transmit the output of the sensor entity of array of sensors 23, in the form of sensor data, to the lighting system controller 11.

Although the sensor 21 or device is shown as a device comprising a single sensor, in some embodiments the sensor 21 may comprise or employ a system of sensors. For example the sensor 21 may represent sensor entities implemented within the lighting system 41.

The sensor 21 and the sensor entity or array of sensors 23 may be any suitable sensor type and/or technology for determining the state of a user or an object interacted with by the user within the sensor range. For example the sensor entity 23 may be a home device monitoring system determining a home device is active or not. For example whether the lights in an area are switched on or off, whether the oven is switched on or off, the heating fire is on or off, the Television is on or off. The sensor 21 may furthermore be implemented within one of the devices being monitored.

The lighting system controller 11 may further be coupled to a smart device or computing device 31. The smart device or computing device 31 may wirelessly be in communication with the lighting system controller 11. The smart device 31 in some embodiments may comprise a processor (or CPU) 33, a memory 35, a user interface 37, and a transceiver (or transmitter) 39. The processor 33 can in some embodiments be configured to execute various program codes. The implemented program codes in some embodiments comprise task generation and analysis output code as described herein. The implemented program codes can in some embodiments be stored for example in the memory 35 for retrieval by the processor 33 whenever needed. The memory 35 could further provide a section for storing data, for example sensor or lighting system control signal data in accordance with the application as described herein.

The user interface (UI) 35 enables a user to input commands to the smart device 31, for example via a keypad, and/or to obtain information from the smart device 31, for example via a display. In some embodiments a touch screen may provide both input and output functions for the user interface.

The smart device in some embodiments comprises a transceiver (TX/RX) 19 suitable for enabling communication with other apparatus, for example via a wireless communication network. The transceiver 19 can communicate with other apparatus by any suitable known communications protocol, for example in some embodiments the transceiver 19 or transceiver means can use a suitable universal mobile telecommunications system (UMTS) protocol, a wireless local area network (WLAN) protocol such as for example IEEE 802.X, a suitable short-range radio frequency communication protocol such as Bluetooth, ZigBee or infrared data communication pathway (IRDA).

The smart device 31, in some embodiments, comprises or may function as a sensor device. For example the smart device 31 may be worn or be held by the user being monitored and function in a manner to provide the user's positional and other movement information. For example whether the user is sitting, standing or lying down.

Furthermore in some embodiments the smart device 31 can be configured to assist the defining of the list of tasks being monitored or receive information as whether there are any outstanding tasks and whether there is a 'next' task to be performed. Thus for example the smart device 31 may be configured to store task definitions (which may or may not be linked to the smart device 31 or the user of the smart device) and supply these task definitions to the lighting system controller 11. In some embodiments the smart device 31 furthermore can be used to provide a suitable lighting system input. In other words to provide to the lighting system controller the indication of the desired lighting output. For example the smart device 31 may implement a lighting control application and be configured to indicate to the lighting controller a desired light scene to be displayed.

The lighting system controller may furthermore be connected or coupled to other devices and/or networks, such as shown in FIG. 1 by the communication with the network (Internet) 51. These other devices/networks may provide further information needed to monitor the performance of the tasks.

Figure 2:
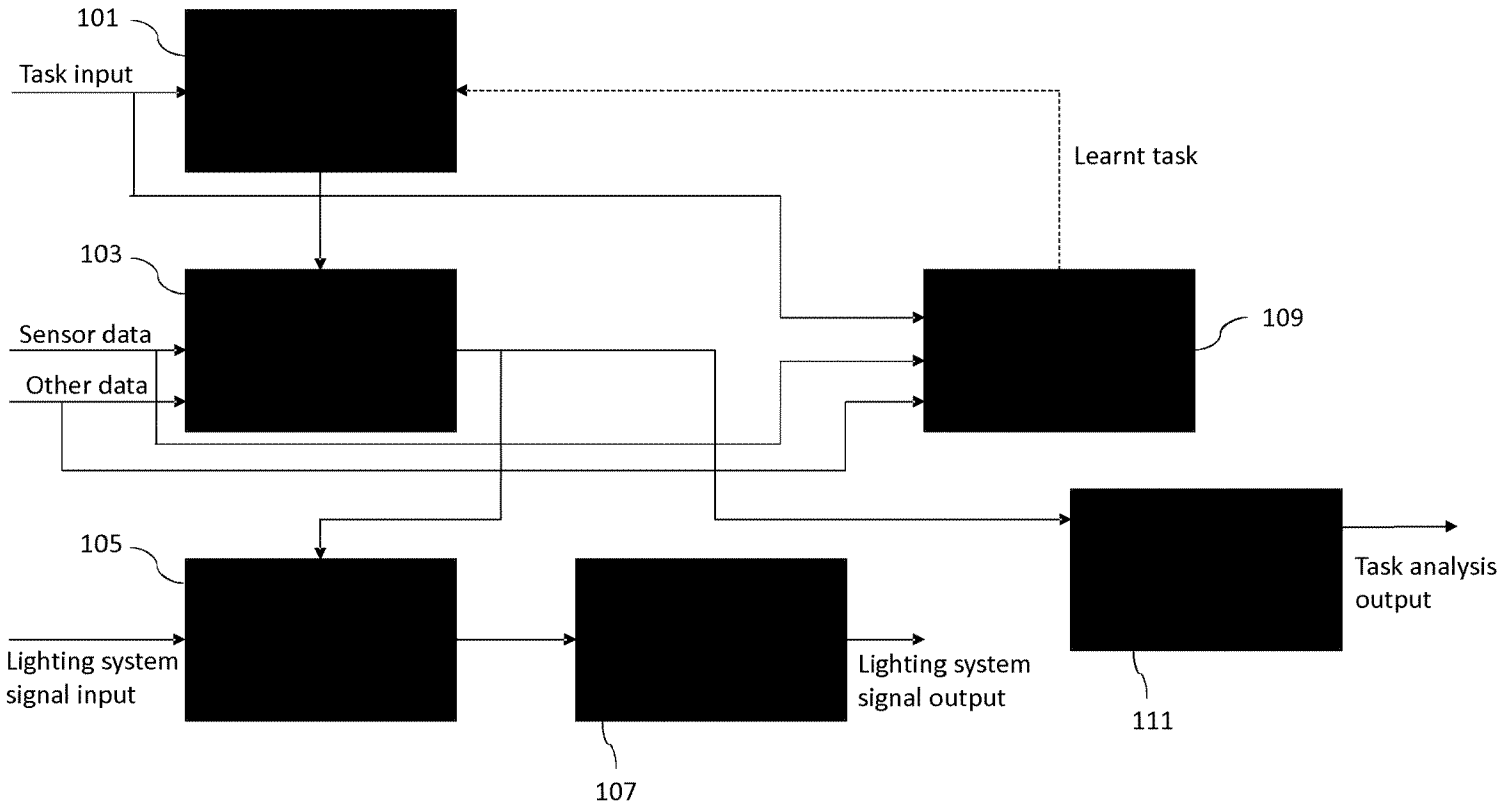
FIG. 2 is a schematic block diagram of a lighting system controller such as shown in FIG. 1 according to some embodiments.

With respect to FIG. 2 some of the functional entities implemented within some embodiments of the lighting system controller 11 are shown in further detail. In some embodiments the lighting system controller comprises a task definer 101.

The task definer 101 may in some embodiments be configured to receive a task input or task inputs. The task input may for example be used to indicate that a task is to be recorded, captured or defined. The task input may in some embodiments may be an input for triggering the transfer of task definitions or similar to the task status determiner 103. For example the task input may be a time based trigger input to start an 'end of shift' sequence of tasks to be transferred to the task status determiner 103. In some other embodiments the task input may be a user input to start the monitoring of the sequence of tasks to be performed.

As well as activation of the task by the user as described herein other inputs may also be associated with the task list are: automated task monitoring, time based task, or other activation via a trigger in the environment.

In some embodiments the definitions within the task list may be associated with a particular person or user of the system. For example the task list may be associated with a child in a family or a particular employee and their role. The identity of the user may be found or determined either directly where a personal device associated with the user is used, or in case of shared devices then identification may be determined based on proximity between a personal device such as a wearable device and the shared device.

In some embodiments the task definitions and therefore the task list is dependent on the location of the user. In such embodiments the definitions and the task lists may need to be transferable to other locations such as when the young family is on holiday or visiting grandparents. In such embodiments the lighting system controller may be configured to enable an auto-search for smart devices that can be tracked.

The task definer 101 may be configured to define or associate at least one task with a control function of the lighting system. The association defined by the task definer 101 can in some embodiments be passed to the task status determiner 103.

In some embodiments the lighting system controller comprises a task status determiner 103. The task status determiner 103 can be configured to receive the defined task or task list from the task definer 101 and furthermore be configured to receive sensor data or other data from external sources. The sensor data may in some embodiments be from a connected system as a sensor network in a home may also contribute to the identification of tasks and their possible completion or not.

The sensor information may be from sensors such as camera vision, presence sensors, magnetic door/window sensors, and so forth. Furthermore the sensor data may further comprise processed sensor data. For example data may be received from camera vision analysis or audio processing. Other data may furthermore comprise data from the internet or smart device based inputs. For example the data may be positional information (geo-fencing), location data, telephone call data (calls made), calendar or agenda items, program or application information (apps opened or closed).

The task status determiner 103 can in some embodiments be configured to compare the sensor data and/or other data against the definitions provided by the task definer 101 to determine the current status of the tasks. The task status determiner 103 can thus be configured to determine whether the tasks have been carried out. Furthermore the task status determiner 103 can be configured to determine whether the tasks have been carried out in the correct order. The determination of the status of the task may for example be performed by comparing the sensor data input against known or recorded sensor data associated with the task. The task status determiner 103 can then be configured to output the determined status to a lighting system signal controller 107 or lighting system signal generator 105.

In some embodiments the lighting system controller 11 may comprise a lighting system signal generator 105. The lighting system signal generator 105 can be configured to receive a suitable lighting system signal input. The lighting system signal input can, for example, be a signal from a physical switch transmitted wirelessly (or otherwise) to the lighting system controller. The lighting system signal input may however be a software defined switch or control input generated by a smart device or other suitable computing device (and performing or running a suitable lighting application) and transmitting the input to the lighting system controller 11. The lighting system signal generator 105 may be configured to determine or generate suitable lighting signals or lighting control signals for outputting to the lighting system 41. The lighting signals may be signals configured to generate the suitable lighting effect desired by the user when operating the switch or software defined switch or control and when the task is completed. Other lighting signals which are generated may be signals configured to generate a warning lighting effect when the switch is operated and when the task has not been completed. The lighting signal may in some embodiments be retrieved from memory on the lighting system controller 11 or received from a further apparatus. In some embodiments the lighting system signal generator 105 may be configured to receive the current status or operation status from the task status determiner 103 and use this information in order to generate the lighting system signals. For example using the 'close office' example the lighting system signal generator 105 having received a light off switch signal from the lighting system signal input and having received the current task status of 'alarm armed' but 'window x open' may be configured to generate a lighting effect signal which would switch all of the lights apart from the one nearest the open window. The lighting system signal generator 105 may further be configured to output this signal to a suitable lighting system signal controller 107.

The lighting system controller 11 in some embodiments comprises a lighting system signal controller 107. The lighting system signal controller 107 may be configured to receive the output of the lighting system signal generator 105 and the task status determiner 103. The lighting system signal controller 107 may further be configured to output the lighting system signal to the lighting system based on the output of the task status determiner 103. Thus for example when the task status determiner 103 has determined that the tasks have been completed or completed in the correct order then the lighting system signal controller 107 can be configured to output the lighting system signal enabling the lighting system to produce the desired lighting effect. Furthermore when the task status determiner 103 has determined that the tasks have not been completed or completed in the correct order then the lighting system signal controller 107 can be configured to output the lighting system signal enabling the lighting system to produce a 'not-complete' or 'error' effect.

To support the operations as described herein in some embodiments, the lighting system controller 11 may further comprise a learning module 109. The learning module 109 may be configured to receive sensor data and/or other data and a task input (or task sequence definition value) and learn or produce a defined learnt task or sequence of tasks whereby a task identifier is associated with the sensor data/other data. The learning module may then be configured to pass the learnt task associations to the task definer 101 such that when the task is recalled at a future time that the task status determiner 103 may have sensor and/or other data to test against in order to determine whether the task has been completed. In some embodiments the learning module 109 may also be used to automatically 'optimize' or 'update' existing activities. Thus for example whenever there are detected changes in the task sequence the learning module is configured to change the definitions automatically and without explicit user triggered updates.

Furthermore in some embodiments the lighting system controller 11 may comprise a task analyzer 111. The task analyzer 111 may be configured to receive the output from the task status determiner 103 and compare the output of the status determiner against known patterns of behavior to determine whether there has been a change in behavior for the tasks and/or generate and output a report based on the analysis of the task. For example the task analyzer 111 may be configured to determine whether a task within a sequence of tasks is being performed accurately and generate a report. The report for example may be stored, for example as a log of the tasks performed which may be retrieved at a later time. The report may furthermore be transmitted or forwarded to a manager or other supervisor to determine whether the tasks have been completed and whether the performance of the tasks has been acceptable.

Figure 3:
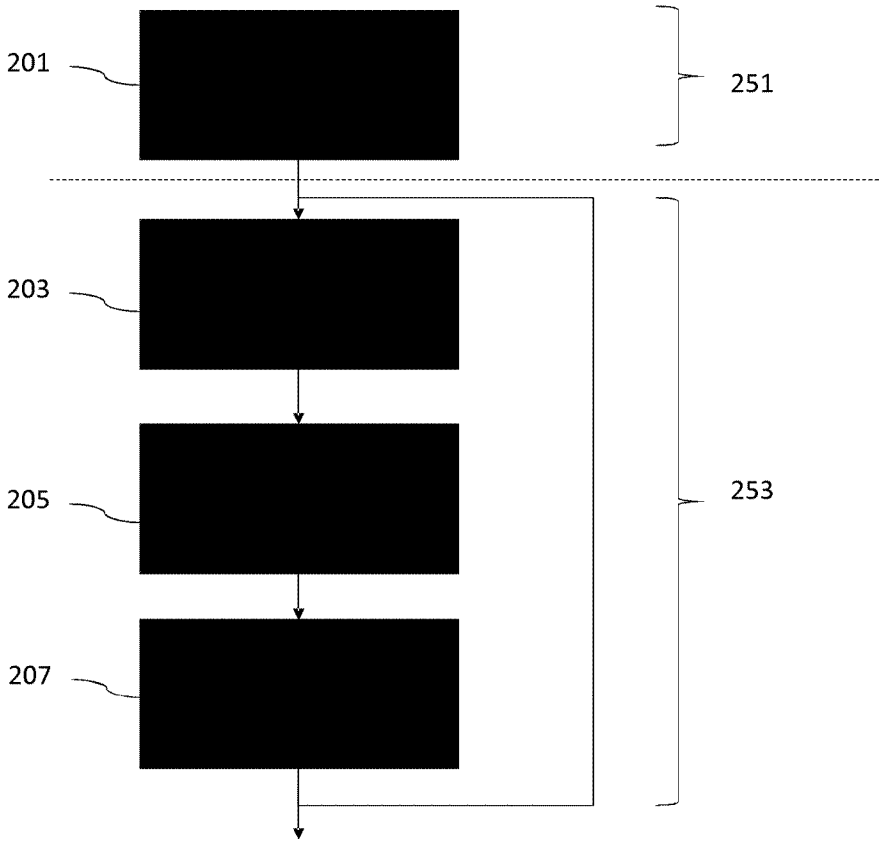
FIG. 3 shows a flow diagram of an overview of a lighting system control method based on task monitoring according to some embodiments.

With respect to FIG. 3 shows an overview of the lighting system control method based on task monitoring according to some embodiments. The lighting system control method may furthermore in some embodiments be implemented within the functional components shown in FIG. 2.

In some embodiments, the lighting system controller, and the task definer/task learner, may be configured to retrieve or generate a definition for at least one task to be monitored. The at least one task in some embodiments comprises a list of tasks. The list of tasks may be an unordered list of tasks. In such embodiments the tasks are defined as being completed when performed in any order. The list of tasks may furthermore be an ordered or partly ordered list of tasks. In other words the tasks (or a sub-group of the tasks) are defined as only being completed when performed in a defined order.

In some embodiments the operation of defining at least one task further comprises associating or allocating at least one sensor signal and/or at least one device signal and/or at least one other signal to the task. This allocation operation may be performed to enable the task status determiner to determine whether the at least one task has been performed.

Furthermore in some embodiments the operation of defining at least one task further comprises associating at least one lighting system output to the task and furthermore the status of the at least one task. For example in some embodiments a first lighting system output, switching all of the lights out, is associated with the at least one task having been performed, and a further lighting system output, flashing or pulsing the lights, is associated with the at least one task not having been performed.

The operation of generating or retrieving the definition of the task is shown in FIG. 3 by step 201.

The operation of defining the task may be considered to be part of a learning or pre-monitoring process performed by the lighting system controller.

The lighting system controller, and the task status determiner, may then be configured to receive sensor and/or other data and the task definitions. This data in some embodiments can be conditioned or processed to produce data which is more easily processed by the status determiner.

The operation of receiving the sensor and/or other data is shown in FIG. 3 by step 203.

The lighting system controller, and the task status determiner, may furthermore be configured to determine the task status or status associated with a list of tasks based on the sensor and/or other data.

For example the determination may be performed by comparing the sensor and/or other data against stored or predetermined sensor/other data associated with the task such that when the received sensor data matches the predefined sensor data indicating that the task is completed then the task is determined to have been completed.

The operation of determining the status of the task based on the sensor and/or other data is shown in FIG. 3 by step 205.

Having determined that the status of the task, the control lighting system can be configured to control the lighting system signal output based on the determined status. For example the lighting system controller, and the lighting system signal generator 105 may be configured to generate a 'success' lighting system control signal and a 'error' lighting system control signal based on receiving a lighting system input for a desired lighting effect to be generated. The lighting system signal controller 107 may be configured to determine whether the task is completed and output the 'success' lighting system control signal on the task having been completed and output the 'error' lighting system control signal on the task not having been completed or only partially completed.

The operation of controlling the lighting system signal output based on the status is shown in FIG. 3 by step 207.

In some embodiments the operation can then loop back such that further sensor and/or other data is received and therefore the tasks are monitored continuously.

The operation steps 203, 205 and 207, in other words the operations of receiving the sensor and/or other data, determining the status of the task based on the sensor/other data, and controlling the lighting system signal output based on the status may be grouped together in an action or monitoring operation shown in FIG. 3 by label 253.

In the examples shown with respect to FIGS. 2 and 3 the at least one lighting control signal is generated based on a lighting system signal input. For example a user attempting to turn off lights when closing the office for the day may activate the 'light toggle switch' (or a timer or received time signal at the specific office closing time) causes the lighting system signal generator to generate an 'off' light control signal as a 'success' lighting control signal and a 'flashing' light control signal as an 'error' lighting control signal. These control signals are passed to the lighting system signal controller and passed to the lighting system based on the determination of the status of a 'closing office' sequence of tasks.

The activation of the 'light toggle switch' (or timer) may furthermore cause the task definer to define the 'closing office' tasks which are passed to the task status determiner and monitored. For example 'closing office' tasks may be defined by the tasks of 'close windows' and 'arm security alarm' tasks.

It is appreciated that in some embodiments the lighting system signal generator functionality may be implemented within the task definer. For example the task definer receives an input such as a light switch, light control input, software defined light switch or control input, or other input for indicating at least one task and associated lighting system control signals based on the status of the task. The task definer then based on the input may define the tasks required to be monitored and furthermore the lighting system control signals associated with possible states of the tasks. The task status determiner may then determine the current status of each task and generate an output for controlling the lighting system signal controller which receives the lighting system control signals.

Figure 4:
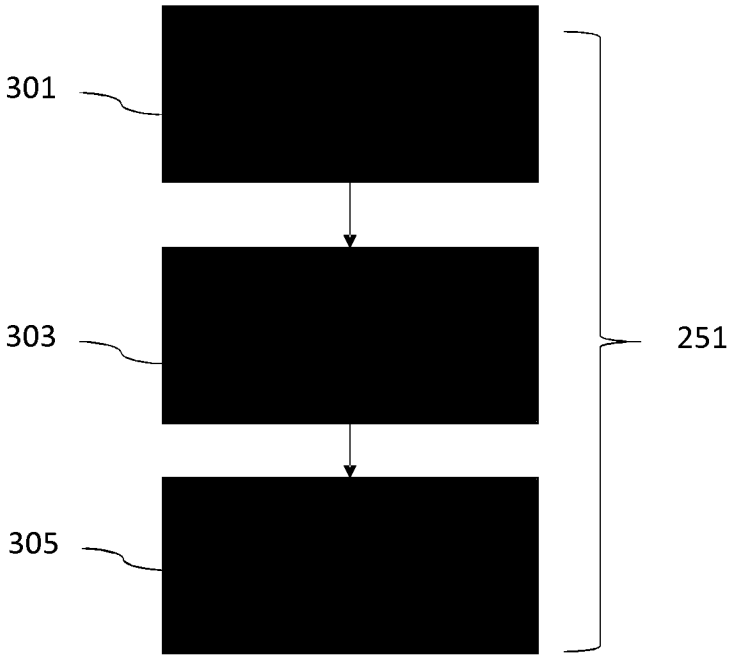
FIG. 4 shows a flow diagram of a task definition method for the lighting system control method as shown in FIG. 3 in further detail according to some embodiments.

FIG. 4 shows a flow diagram of an example method for generating a task definition for the lighting system control method as shown in FIG. 3 in further detail.

In some embodiments, the lighting system controller may receive or determine a define/record task indicator. The define/record task indicator in some embodiments may be in the form of the task input passed to the task definer and information to further associate the status of the task with at least one specific lighting effect.

The operation of defining the task (or recording the task) is shown in FIG. 4 by step 301.

In some embodiments sensor data associated with the task is received. In some embodiments this sensor data is 'simulated data'. For example in the 'close windows' task described above the sensor data may be simulated window magnetic proximity sensor data or the expected output from the security system. In some embodiments the sensor data is the actual sensor data as the task is performed. For example the output from the window sensors or the security system as someone is closing the windows in the office.

The operation of receiving the sensor data (as the task is being performed) is shown in FIG. 4 by step 303.

In some embodiments this 'real-time' sensor data may be passed to the learning module 109 which is configured to associate the sensor data with the task. In such embodiments the task is defined by the association between the task indicator and the sensor data. Thus when the task input with the same indicator is received again the task definitions may be retrieved and any received sensor data compared against the definition sensor data to determine the status of the tasks being performed.

Figure 5:
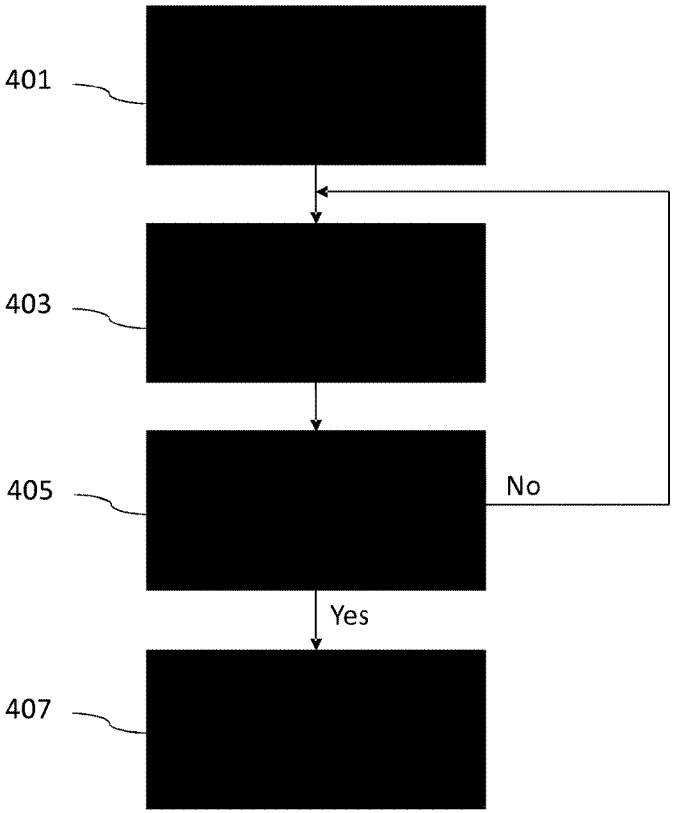
FIG. 5 shows a flow diagram of the lighting system control method as shown in FIG. 3 in further detail according to some embodiments.

FIG. 5 shows a flow diagram of the lighting system control method as shown in FIG. 3 in further detail according to some embodiments.

The lighting system controller can in some embodiments receive the lighting system signal input. The lighting system signal input can as described herein be an input such as a light switch, light control input, software defined light switch or control input, or other input for indicating at least one task (and associated lighting system control signals based on the status of the task). The lighting system signal input may furthermore identify a task or sequence of tasks to be monitored.

The operation of receiving the lighting system input is shown in FIG. 5 by step 401.

The lighting system controller, and for example the task definer, may then retrieve the definitions associated with the tasks identified by the lighting system signal input. The lighting system controller may, and for example the lighting system signal generator, then generate any lighting system control signals based on the received lighting system input.

For example a user attempting to turn off lights when closing the office for the day may activate the 'light toggle switch' (or a timer or received time signal at the specific office closing time) which causes the task definer to retrieve the definitions associated with a 'close office' sequence of tasks. These definitions may be associated with 'close windows' and 'arm security alarm' tasks and be further defined based on window sensor signals (for the 'close windows' task) and security alarm system signals (for the 'arm security alarm' task)

Furthermore in response to the input the lighting system signal generator may generate an 'off' light control signal as a 'success' lighting control signal and a 'flashing' light control signal as an 'error' lighting control signal. These control signals are passed to the lighting system signal controller and passed to the lighting system based on the determination of the status of a 'closing office' sequence of tasks.

The operation of retrieving the task definitions and generating the lighting system control signals based on the input is shown in FIG. 5 by step 403.

The status of the tasks can then be checked. This can for example be from the output of the task status determiner which compares the task definitions against the received sensor/other data. Thus for example when the window sensors indicate that all of the windows are closed then the status of the task 'close windows' can be determined as complete. Similarly the security alarm can provide an indication that the alarm has been armed to enable the status of the task 'arm alarm' to be determined as being complete.

The operation of checking the status of the task in other words determining whether or not the current status is OK, is shown in FIG. 5 by step 405.

Where the status is not OK in other words that the current status indicates that the task has not been completed or completed in an incorrect order then the operation can loop back on to itself. For example the operation may loop back to retrieving the task definitions and generating the lighting system control signals and perform a further check status operation.

In some embodiments when the status for the task is not OK then the lighting system controller, for example the lighting system signal controller, may be configured to output a defined lighting effect based on the status being not OK. For example the 'flashing' light control signal may be output as an 'error' lighting control signal. It is understood that the lighting effect in some embodiments may assist the user of the lighting system in identifying the 'error' or the incomplete task. For example in some embodiments the lighting system controller is configured to generate and output a lighting effect flashing a defined number of times indicating the missing or out of order task, or changing the lighting effect color to a defined color, or activating a lighting effect positional light. Thus for example in the 'close office' example the luminaires closest to an open or unlocked window can be flashed to indicate any windows still open.

Where the status is OK then the lighting system controller can be configured to output the generated lighting system control signal. Thus the lighting system signal controller may output the 'off' light control signal when the 'close office' task has been completed.

The operation of outputting the lighting system control signal based on the status being OK is shown in FIG. 5 by step 407.

Although the example provided above is with respect to an office task. It is understood that the embodiments described herein may be applied to 'home' or 'residential' applications. For example the embodiments may be applied to monitor the 'bed-time' tasks for a child. In such an example 'Andy' is getting ready for bed. He knows that he has to complete a few tasks before his bedtime story. He starts with cleaning his teeth which he likes doing as the toothpaste tastes good! Next he washes his hands and face and runs into his bedroom ready for his story. He reaches out and turns the light switch but nothing happens a gentle flicker is all he gets. Hmmm, what did he forget to do? He thought for a moment and then he remembered, he had to put today's clothes in the wash basket. Job done, he tries the switch again and on comes the beautiful night light by which he can read his book for a few minutes before it is time to sleep. In such embodiments the tasks may be defined as 'cleaning teeth', 'bedtime wash' and 'clean room—clothes in basket'.

A further example may be assisted-care residences. For example in two weeks Jenny will celebrate her 85th birthday and she is looking forward to seeing her family for a dinner at the weekend. She enjoys living independently however, over the past few years she has been getting a little more forgetful. To help her, her family installed a helpful reminder system. After lunch for example, a couple of the lights in her lounge are configured to turn blue to signify that she has a task still to complete. She is then triggered to try and remember what she needed to still do. Consulting her list, she may have seen that she had not taken her after lunch medication. Once taken the lights could then return to their original setting. In such an example any control input prior to completing the task would not change the lights from being blue.

Furthermore such embodiments may be implemented in retail environments. For example Simon runs a small shop and for much of the time it is only him or his assistant managing the store. Since he now has a young family he wants to spend more time with them rather than being at the store all the time and so he trains and trusts his assistant to close up at the end of the day. This requires a particular set of tasks to be completed, but on a few occasions he notices that some tasks have not been completed. To help out, a lighting reminder system is activated. Now, at the end of the day, when the assistant is leaving and attempts to turn off the main lights, if nothing happens or they just flash a color and went back to white when flicking the switch he knows he has forgotten to do something. Consulting the light sequence task list on their phone it can point out what has been over looked. Once attended to, the lights can then turn off.

The advantage of using light is that it is highly visible. Whether the switch reacted to a command or not is noticeable as the brain is expecting an event to occur (i.e. change in light level) and should this not occur it will be a noticeable break in a pattern causing people to stop and think.

The examples described herein feature a lighting control system which links to a lighting system associated with a particular location. However, in some embodiments the lighting system may be within a vehicle. Thus for example a delivery driver may have a special light system in his vehicle that can only be turned off when all the parcels in the back of the vehicle have been delivered or processed for the location he is at, thus preventing him forgetting to deliver any and drive off. In such embodiments the task list may be one defined with prioritization of tasks (delivery items) based on the contents of the vehicle and its location.

Examples of possible implementations of the embodiments may be:

in the home using a hue system to help train children or assist elderly in completing set tasks;

in business environments (such as retail) to help remind staff to complete certain tasks before they leave the building;

in safety critical environments such as ground staff at an airport to be sure all key checks have been made. This then generates a visual cue for others who may be located at a distance from those checking, for example pilots in the plane;

in motorsport to inform the pit when all the tasks are completed before releasing a car back into the race.

As described herein in some embodiments the output of the task status determiner may be analyzed. With respect to FIG. 6 a flow diagram of a task analysis method for the lighting system control method is shown according to some embodiments.

The status associated with the task being performed may be received by the task analyzer 111.

Figure 6:
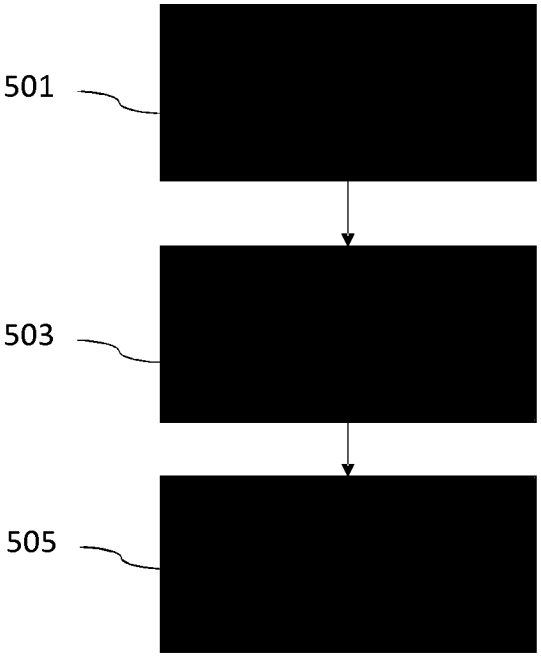
FIG. 6 shows a flow diagram of a task analysis method for the lighting system control method as shown in FIG. 3 according to some embodiments.

The operation of receiving the status output is shown in FIG. 6 by step 501.

The status output can then be analyzed to determine whether there is a pattern of behavior or whether the pattern of behavior has changed since the last time the task or sequence of tasks have been performed. This can for example indicate whether the task or tasks have been completed. the order of completion of the tasks within a sequence of tasks, the speed of completion of the task or tasks, the accuracy of the completion of the task or tasks, whether the sequence of tasks were missed or not performed according to defined parameters.

The operation of analyzing the status output to determine the pattern of behavior or change in pattern of behavior is shown in FIG. 6 by step 503.

Furthermore in some embodiments the determination of a pattern of behavior or change in pattern of behavior can lead to the generation of a report of the behavior or change of behavior.

For example the task analyzer 111 may be configured to generate a message (for example a short message service (sms) or automated email) and send the message to a user's or designated manager mobile device when it is determined that the task has now been performed accurately or efficiently.

Similarly the task analyzer 111 may be configured to determine whether a task within a sequence of tasks is being performed accurately and generate a report. The report for example may be stored, for example as a log of the tasks performed which may be retrieved at a later time. The report may furthermore be transmitted or forwarded to a manager or other supervisor to determine whether the tasks have been completed and whether the performance of the tasks has been acceptable.

Thus the task analyzer 111 may be a real-time analysis of the task status (such as generating sms or email messages in real time to provide a further indication when the task has been correctly or incorrectly performed). In some embodiments the task analyzer 111 may be a data analysis tool suitable for analyzing past performance and for task optimization or evaluation purposes (such as the generation of task behavior reports).

The operation of generating the report of the behavior is shown in FIG. 6 by step 505.

Thus based on the known/recorded pattern of performance of tasks, the lighting system controller may be able to provide suggestions to optimize the pattern of performance. This may for example be performed as part of a time and motion study where time is of the essence. Furthermore as discussed herein the report may identify deviations from the pattern of performance of task. This may be useful in health related contexts as this might identify for example forgetfulness or a decrease in health of the user.

Figure 7:
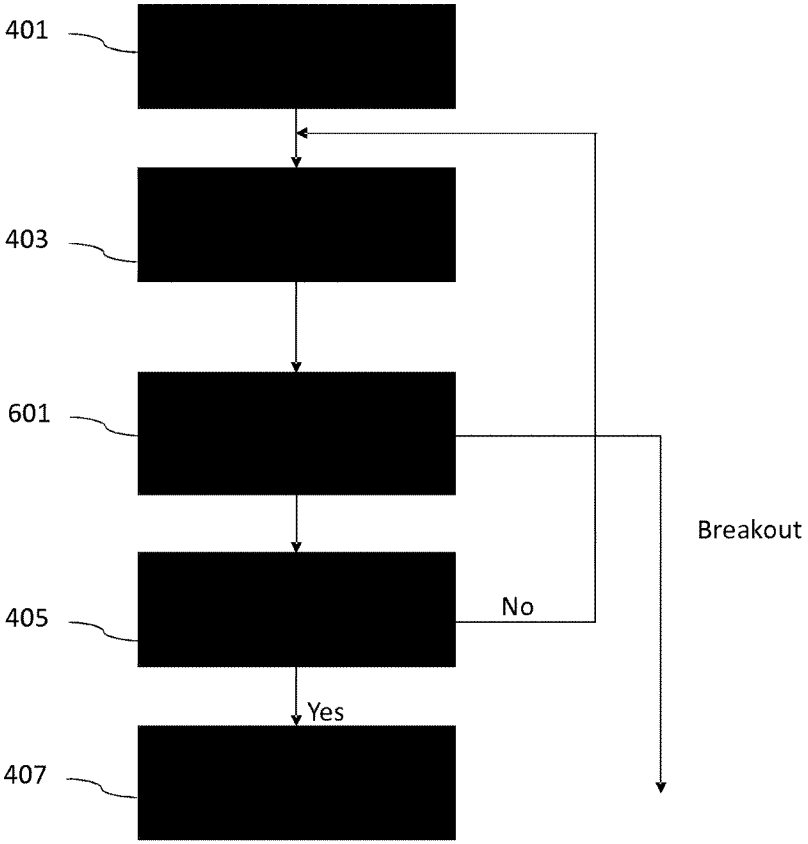
FIG. 7 shows a flow diagram of a further lighting system control method as shown in FIG. 3 in further detail according to some embodiments.

FIG. 7 shows a flow diagram of a further lighting system control method which differs from the embodiments shown with respect to FIG. 5 in that a break condition operation is inserted in between the operations of generating the lighting system control signal and checking the status of the task.

The break condition is configured to break the loop of the checking of the status of tasks. The break condition can for example be a time-out or an override or other suitable interrupt.

The break condition operation is shown in FIG. 7 by the introduction of operation 601 between the operations 403 and 405 with the loop of 405 passing back to the operation 601 rather than the start of operation 405 as shown in FIG. 5.

In some embodiments the break condition operation may be an override function which requires user identification and so prevents a complete lock out of all functionality. For safety, this override function may be included as there are times when users need the light for other reasons and it may be dangerous to keep the lock on indefinitely until all the tasks have been completed. In some embodiments the override function may have a clear user interaction element so that the user confirms the override and the non-completion of the tasks or a message is sent to others informing them that the task list has not been completed (for example by the generation of a suitable report as described herein).

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored and/or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A lighting system controller configured to control at least one controllable luminaire, the lighting system controller comprising:

a task definer configured to define at least one task to be performed;

a status determiner configured to determine a status of the at least one task based on comparing sensor data, received from at least one device, against definitions provided by the task definer, wherein the at least one device is physically separated from the lighting system controller and is arranged for determining a state of an object interacted with by a user;

a control signal generator configured to generate at least one lighting system signal based on a received lighting system signal input, received from a physical or software defined switch, indicative of a lighting effect desired by a user, and a control signal controller configured to output the at least one lighting system signal to the at least one controllable luminaire enabling the lighting system to produce the desired lighting effect based on the status determiner indicating that the at least one task has been completed.

2. The lighting system controller as claimed in claim 1, wherein the task definer is further configured to define a task order for the at least one task to be performed, and the control signal controller is configured to output the at least one lighting system signal to the at least one controllable luminaire based on the status determiner indicating that the at least one task has been performed in the defined order.

3. The lighting system controller as claimed in claim 1, further comprising:

a wireless receiver configured to receive the sensor data from the at least one device physically separated from the lighting system controller.

4. The lighting system controller as claimed in claim 1, further comprising:

a wireless transmitter configured to transmit the at least one lighting system signal to the at least one controllable luminaire.

5. The lighting system controller as claimed in claim 1, wherein the task definer is configured to receive the at least one task to be performed from a physically separate device.

6. The lighting system controller as claimed in claim 1, further comprising a task recorder configured to:

analyse the sensor data received from the at least one device physically separated from the lighting system controller to determine a pattern of sensor data associated with at least one task; and determine a definition for the at least one task comprising the determined pattern of sensor data associated with the at least one task.

7. The lighting system controller as claimed in claim 1, further comprising a task analyzer configured to analyses status output data from the task status determiner and determine a performance analysis of the at least one task.

8. A lighting system comprising:

the lighting system controller as claimed in claim 1;

the at least one controllable luminaire in communication with the lighting system controller; and the at least one device in communication with the lighting system controller, the at least one device comprising at least one sensor for generating the sensor data.

9. A computer program product comprising code embodied on one or more computer-readable storage media and/or being downloadable therefrom, and being configured so as when run on a lighting system controller to perform operations of:

define at least one task to be performed;

determine a status of the at least one task based on comparing sensor data received from at least one device against the at least one task definition, wherein the at least one device is physically separated from the lighting system controller and is arranged for determining a state of an object interacted with by a user;

receive a lighting system signal input from a physical or software defined switch, indicative of a lighting effect desired by a user;

generate at least one lighting system signal based on the received lighting system signal input, and control, based on the determined status indicating that the at least one task has been completed, the output of the at least one lighting system signal to the at least one controllable luminaire thereby enabling the lighting system to produce the desired lighting effect.

10. A method of controlling a controllable luminaire comprising:

defining at least one task to be performed;

determining a status of the at least one task based on comparing sensor data received from at least one device against the at least one task definition, wherein the at least one device is physically separated from the lighting system controller and is arranged for determining a state of an object interacted with by a user;

receiving a lighting system signal input from a physical or software defined switch, indicative of a lighting effect desired by a user;

generating at least one lighting system signal based on the received lighting system signal input, and controlling, based on the determined status indicating that the at least one task has been completed, the output of the at least one lighting system signal to the at least one controllable luminaire thereby enabling the lighting system to produce the desired lighting effect.

11. The method as claimed in claim 10, wherein defining the at least one task to be performed comprises defining an order for the at least one task to be performed, and controlling the output of the at least one lighting system signal to the at least one controllable luminaire comprises controlling the output of the at least one lighting system signal based on the status indicating that the at least one task has been performed in the defined order.

* * * * *